US005562361A

United States Patent [19]

Allen

[11] Patent Number: 5,562,361

[45] Date of Patent: Oct. 8, 1996

[54] TRIPLE ROLLER TUBE CONCRETE FINISHER

[75] Inventor: J. Dewayne Allen, Paragould, Ark.

[73] Assignee: Allen Engineering Corporation, Inc., Paragould, Ark.

[21] Appl. No.: 385,631

[22] Filed: Dec. 8, 1995

[51] Int. Cl.[6] ..... E01C 19/28

[52] U.S. Cl. ..... 404/103; 404/122; 404/123; 425/62

[58] Field of Search ..... 404/72, 101, 103, 404/114, 117, 118, 122, 123, 125, 129, 132; 425/62

[56] References Cited

U.S. PATENT DOCUMENTS

| | | | |
|---|---|---|---|
| 3,541,931 | 11/1970 | Godbersen | 404/122 |
| 3,797,953 | 3/1974 | Lindskog | 404/101 |
| 4,614,486 | 9/1986 | Bragagnini | 404/103 |
| 5,046,889 | 9/1991 | Sterner, Jr. | 404/122 |

*Primary Examiner*—Michael Powell Buiz
*Assistant Examiner*—Pamela A. O'Connor
*Attorney, Agent, or Firm*—Stephen D. Carver; Trent C. Keisling

[57] ABSTRACT

A triple roller tube concrete finisher that uses rotating tubes to strike-off, screed and finish concrete. The machine rides upon concrete forms and comprises a box-like, generally parallelepiped, frame supported by a plurality of rotary rollers. The frame houses an engine, cleaning system and a hydraulic system. The engine powers the hydraulic system that rotates the rollers. Two of the rollers provide locomotion to the machine while simultaneously screeding and finishing concrete the machine moves over. Preferably, these drive rollers are bidirectional to facilitate forward and rearward movement of the finishing machine. One of the rollers functions like a strike-off to prevent ride up. This roller rotates counter to the drive rollers to grade and displace excess unlevel concrete away from the leading edge of the machine. Preferably, the vertical height of the strike-off roller and its axis of rotation may be adjusted to vary the resulting depth of the concrete passing thereunder. A pivoting housing attaches the strike-off roller to the frame and permits the vertical displacement of the roller. The strike-off roller moves the excess concrete away from the frame, forming an intermediate zone. The drive rollers then compress and screed the intermediate zone to yield a finished slab of compacted concrete. A hydraulically displaceable leg depends from the frame and may be selectively actuated to lift the drive rollers off the forms. An operator controls the rollers and a steering system from a central location.

5 Claims, 5 Drawing Sheets

TRIPLE ROLLER TUBE CONCRETE FINISHER

BACKGROUND OF THE INVENTION

I. Field of the Invention

This invention relates generally to finishing assemblies and machines, primarily screeds and strike-offs for placing, screeding, finishing and shaping concrete. More particularly, the present invention relates to a self-propelled finisher that employs multiple rotating tubes to simultaneously propel the machine while finishing, striking-off and screeding concrete.

II. The Prior Art

As recognized by those skilled in the concrete finishing arts, after concrete is initially placed during construction, the upper surface must be appropriately finished. The purpose of finishing is to give the concrete a smooth, homogeneous and correctly textured surface and appearance. Various finishing devices have long been in use throughout the construction industry for treating plastic concrete. Known prior art systems include "bull" floats, finishing boards, strike-offs, pan floats, plows, blades, rotary tubes and the like.

Generally, most concrete finishing assemblies employ a combination of the above devices to finish the concrete. Strike-offs are principally used to initially form and grade fresh concrete by contacting the rough, freshly placed plastic concrete with a leading edge. Screeds are normally elongated tools that employ a leading surface or blade that is moved over the concrete surface to finish it. These finishing assemblies may float on the concrete itself or they may ride the surrounding concrete forms. Modern finishing machines allow several finishing steps to be accomplished in a single pass.

During construction concrete may be poured between spaced-apart forms and then finished while still plastic. Typically, the freshly poured concrete is supplied in an excessive amount to insure that the resultant concrete slab is of the proper size and depth. Those skilled in the art will recognize that the selected finishing equipment must be appropriately matched to the job. In other words, the type of equipment must be chosen based on the condition of the concrete. For example, if high slump concrete is to be screeded, a floating pan would be ideal. For finishing drier concrete, a heavier twin-bladed screed might be more desirable. In all cases it is desirable to finish the concrete quickly and efficiently in a single pass.

The selection of an appropriate design for a particular finishing machine or assembly is also based upon a variety of parameters dependent upon the concrete involved. The characteristics of a particular batch of concrete depend upon the type and percentage of aggregate, and the quality and quantity of sand, cement, ad-mix, water and chemical additives used to formulate the concrete. Other variables, such as temperature, slab thickness, slump and placement method also affect the finishing assembly selection and the application procedure.

A particular problem the excess concrete commonly used in most projects causes is that it often makes ordinary form riding rotary tube finishers "ride up" on top of the concrete. Another problem results from the fact that concrete poured by the delivery truck is concentrated in one area and must be spread out. Extreme surface irregularities in unfinished areas result. In effect, large bumps and extremely unlevel regions in the concrete surface arise. Bumps can cause finishers to "ride up." If the finisher drive rollers "ride up," they lose contact with the forms. When the rollers do not contact the forms, they no longer finish the concrete surface correctly and are unable to continue independent movement. Thus, some of the excess, freshly poured, unlevel plastic concrete must normally be displaced away from the finisher.

I hold several patents in the art of concrete placement and finishing. The most relevant is U.S. Pat. No. 4,702,640 that teaches a single roller concrete finisher that utilizes a pair of cooperative end handle assemblies. This single roller system is directed at finishing concrete upon sloping surfaces.

My U.S. Pat. No. 4,349,328, teaches a self-propelled "triangular truss" screed that rides upon forms U.S. Pat. No. 4,798,494 discloses a floating vibratory screed that finishes concrete with or without forms.

Finally, U.S. Pat. Nos. 4,316,715, 4,363,618 and 4,375,351 and the various references cited and discussed therein are germane to the general technology discussed herein. All the above patents have been assigned to the same assignee as the present case.

U.S. Pat. No. 4,142,815, issued Mar. 6, 1979, to David Mitchell teaches a rotary tube finisher that is adapted to rotate counter to the directional movement of the finisher. This patent does not teach a reliable method of finishing the concrete in a single pass. This device also fails to provide a vertical adjustment for the movement of the rotary tube relative to the supporting forms.

Other prior art screeds, generally of the "form-riding" type, that are of general relevance include those screeds disclosed in U.S. Pat. Nos. 4,340,351; 4,105,355; 2,651,980; 2,542,979; 3,095,789; 2,693,136; and 4,030,873.

The prior art has failed to adequately address the "riding up" problem associated with the use of rolling tube finishers. Many of the prior art finishers fail to effectively finish freshly poured plastic concrete in a single pass. Furthermore, the prior art fails to teach an efficient method of displacing excess, unlevel concrete to maintain drive roller contact on self-propelled form riding concrete finishers. The prior art also fails to provide an adjustable, integral strike-off roller that is vertically adjustable to vary the depth of the concrete adjacent the drive rollers.

Ideally, a finishing machine would use a plurality of rollers to compress the concrete while also preventing "riding up." It would also level or grade and displace excess, unlevel concrete away from the front or leading edge of the finishing machine.

Thus, it is desirous to provide a finishing machine that will finish freshly placed plastic concrete effectively in a single pass. The device should be self-propelled, and it must be able to effectively strike-off excess concrete adjacent the leading edge of the machine. An acceptable machine must not "ride up" over the concrete and loose motive contact with the forms.

SUMMARY OF THE INVENTION

I have provided triple roller tube concrete finisher that uses rotary tubes or rollers to strike-off, screed and finish plastic concrete. The self-propelled finishing machine rides upon a pair of parallel, spaced-apart forms that restrain plastic concrete during construction.

The machine comprises a generally box-like, parallelepiped frame supported by a plurality of rotary rollers. The frame mounts an engine, water tank and nozzle cleaning system and a hydraulic pump and control system to control the rotation of the rollers. The engine operates a hydraulic pump that remotely powers the rotary rollers.

In one preferred embodiment, two rollers propel the machine. The drive rollers also simultaneously screed and finish the concrete the machine moves over. Preferably, these drive rollers are bidirectional to facilitate forward and rearward movement of the finishing assembly.

One of the rollers initially strikes-off and shifts excess raw concrete forwardly to pre-level the slab. This prevents the assembly from "riding up" on top of surface irregularities in the unfinished concrete. This striking roller revolves in a direction opposite to the normal drive roller rotation. This counter-rotation displaces excess, unlevel plastic concrete away from the leading edge of the machine. Preferably, the vertical height of the strike-off or screed roller may be adjusted to vary the resulting depth of the concrete passing thereunder.

A pivotal housing attaches the striking roller to the frame, permitting the vertical displacement of the roller. Thus, the striking roller functions as a strikes-off to displace the excess concrete and form an intermediate zone. The drive rollers then compress and screed the intermediate zone of concrete to form a finished slab of compacted concrete.

An operator may control the direction and rotational speed of the rollers from a central location. A hydraulically displaceable leg mounted at one end of the frame permits an end of the drive rollers to be lifted off the forms to steer the machine.

Thus, it is a basic object of the present invention to provide a self-propelled concrete finishing machine that strikes-off excess, unlevel concrete adjacent the leading edge of the machine while screeding and finishing concrete the machine moves over.

Another basic object of the present invention is to use a self-propelled, form riding finishing machine to finish freshly placed plastic concrete in a single pass.

A related object of the present invention is to provide a machine that uses a rotary roller tube to displace excess, unlevel, freshly poured plastic concrete away from the front of the finishing machine.

Another object of the present invention is to provide a concrete finishing machine that may be driven forwards and backwards.

Another basic object of the present invention is to provide a concrete finishing machine that may be turned.

A related object of the present invention is to provide a concrete finishing machine that uses a hydraulic piston to lift one end of the machine to facilitate steering.

A basic object of the present invention is to provide a self-propelled concrete finishing machine that is adapted to ride upon concrete forms.

A related object of the present invention is to provide a concrete finishing machine that provides a user selected depth of concrete adjacent the drive rollers.

A related object of the present invention is to provide a pivotal connection between the frame of the finishing machine and the leading rotary tube roller whereby the axis of rotation of the roller may be vertically displaced.

A basic object of the present invention is to provide a concrete finishing machine wherein the leading rotary tube may be cleaned.

A related object of the present invention is to provide a machine that uses a water spray nozzle system to clean the leading roller.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 1:
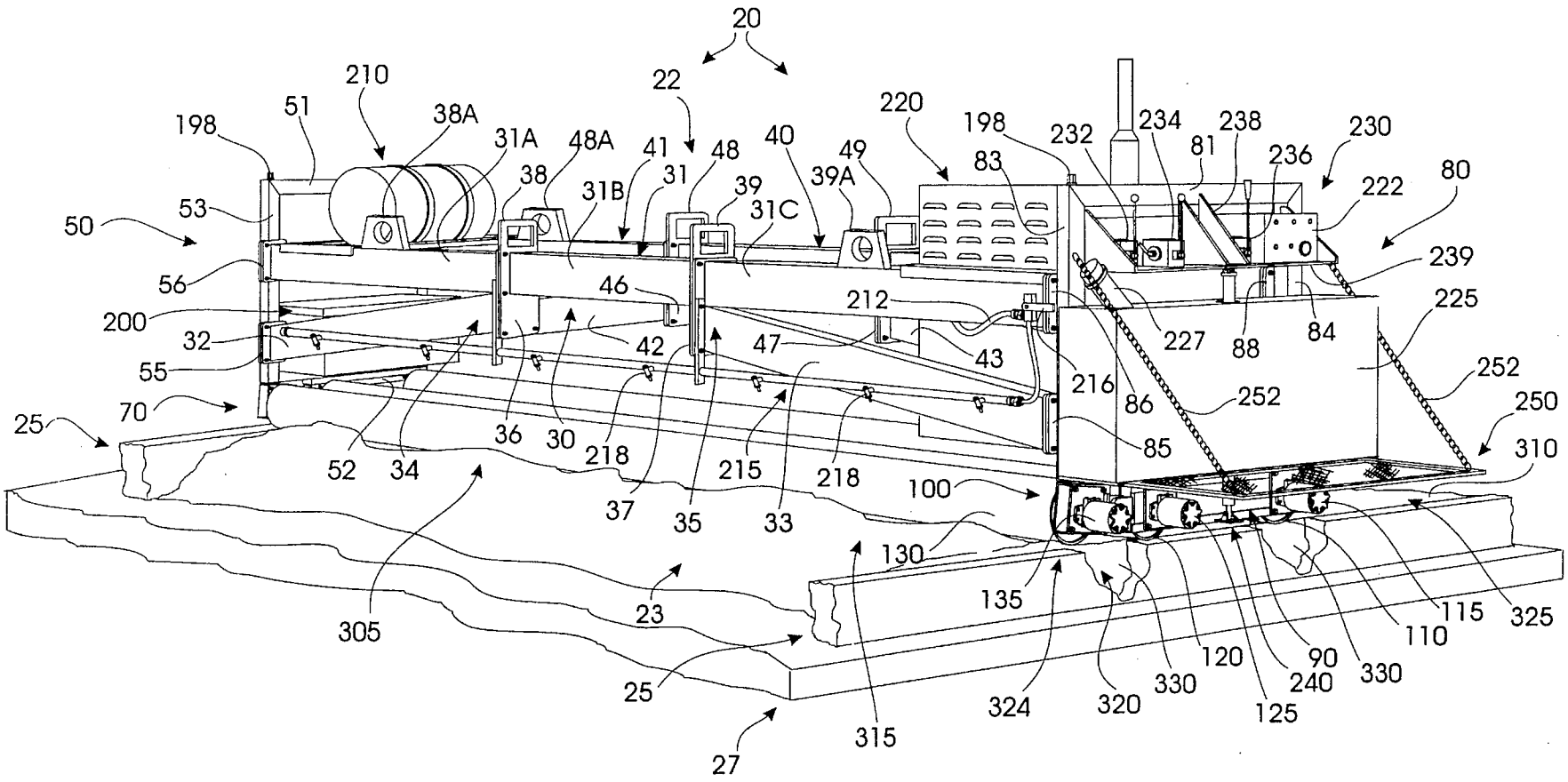
FIG. 1 is a fragmentary environmental, perspective view of the best mode of my Triple Roller Tube Concrete Finisher, showing the machine traveling on forms while finishing concrete.

With attention now directed to the accompanying drawings, my triple roller tube concrete finisher is broadly designated by the reference numeral 20. Finisher 20 ideally rides upon spaced apart forms 25 to finish and level fresh concrete 23.

Figure 2:
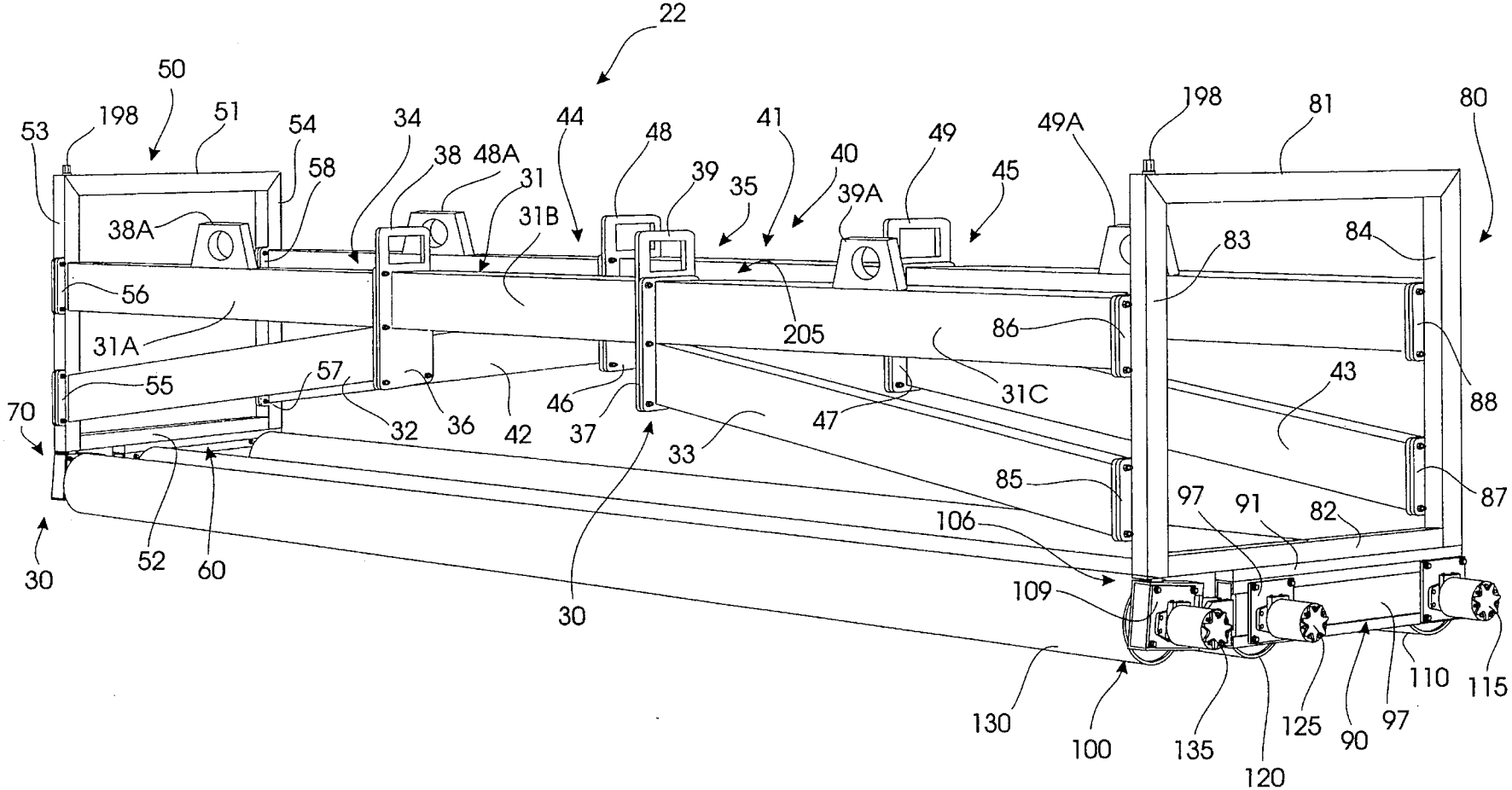
FIG. 2 is an enlarged perspective view similar to FIG. 1, showing the frame of the machine with various pieces omitted for clarity.
Figure 3:
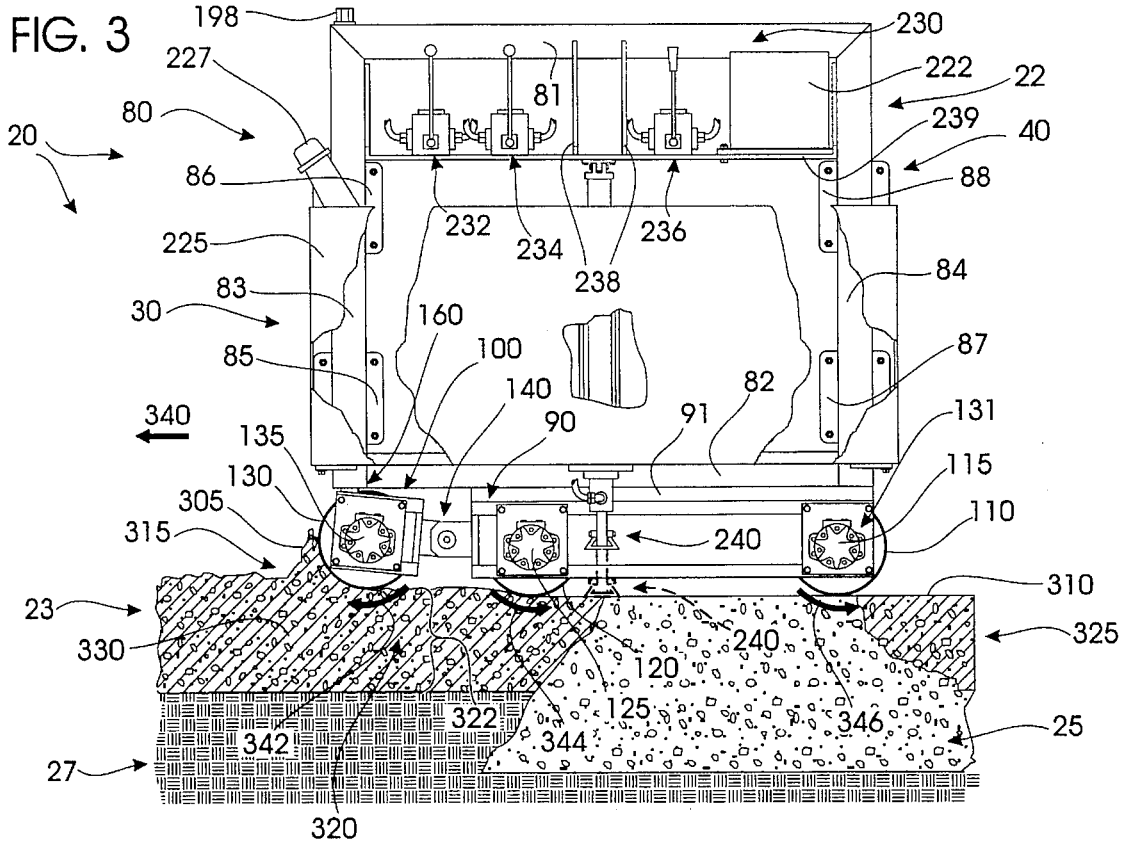
FIG. 3 is a fragmentary end elevational view showing the machine from the drive end, with portions omitted and pieces broken away for clarity.
Figure 4:
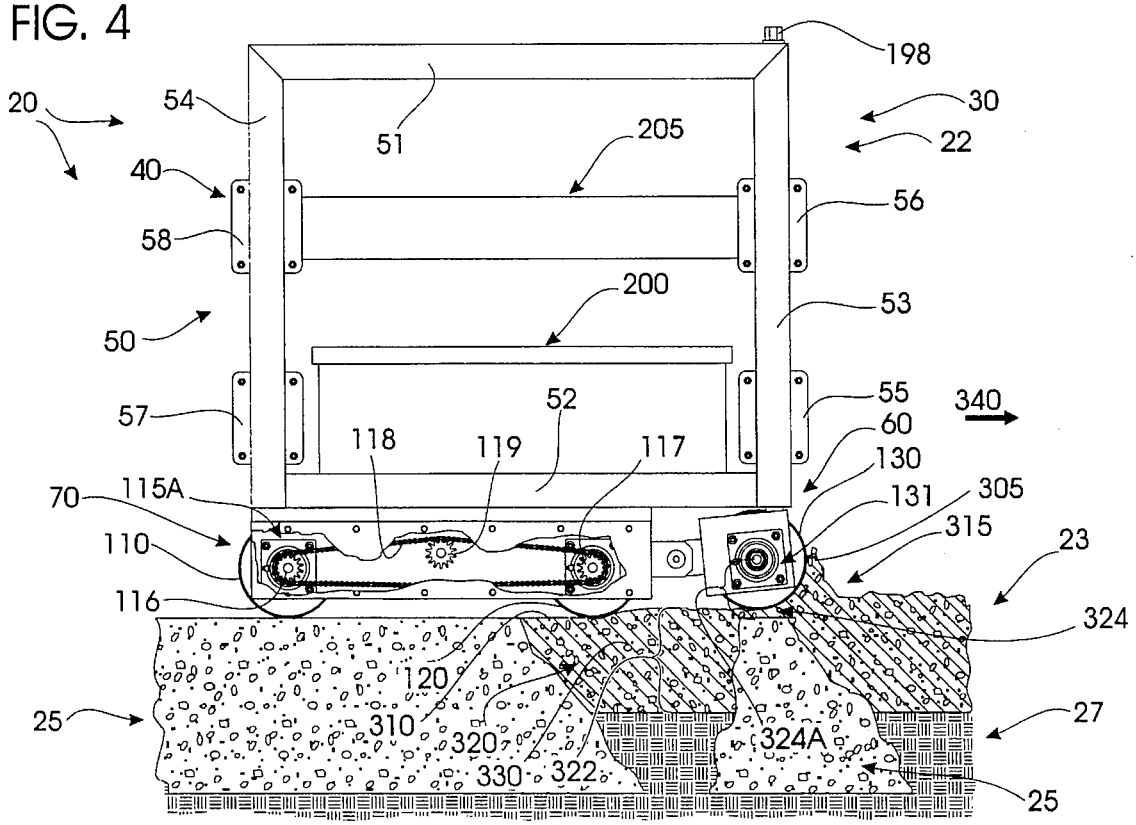
FIG. 4 is a fragmentary end elevational view similar to FIG. 3, showing the opposite end with portions omitted and pieces broken away for clarity.
Figure 5:
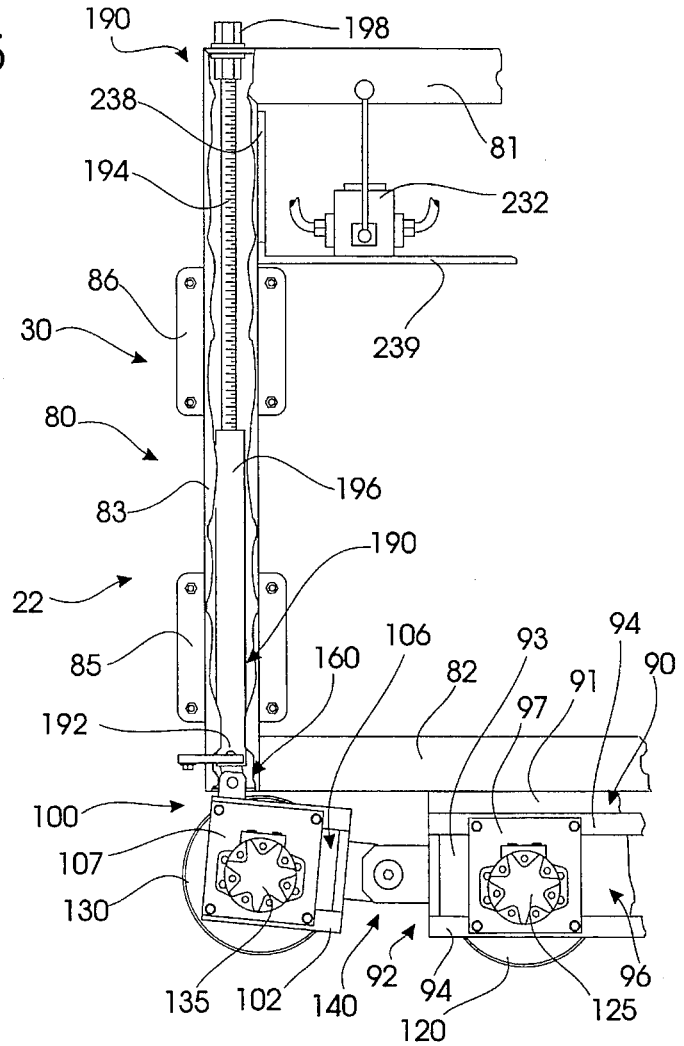
FIG. 5 is an enlarged, fragmentary elevational view similar to FIG. 3, showing the machine from the drive end, with portions omitted and pieces broken away for clarity.
Figure 6:
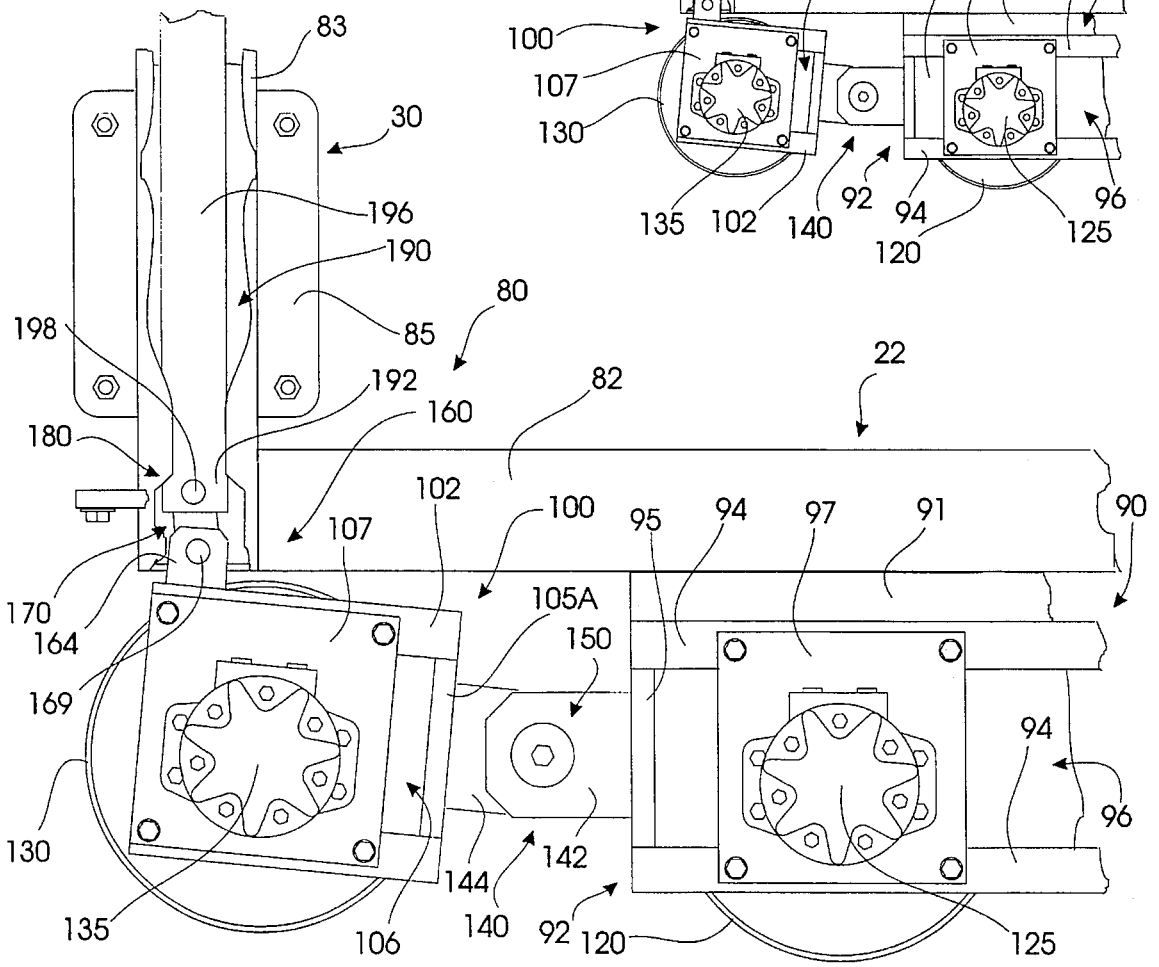
FIG. 6 is a greatly enlarged, fragmentary elevational view similar to FIG. 5, showing the machine from the drive end, with portions omitted and pieces broken away for clarity.
Figure 7:
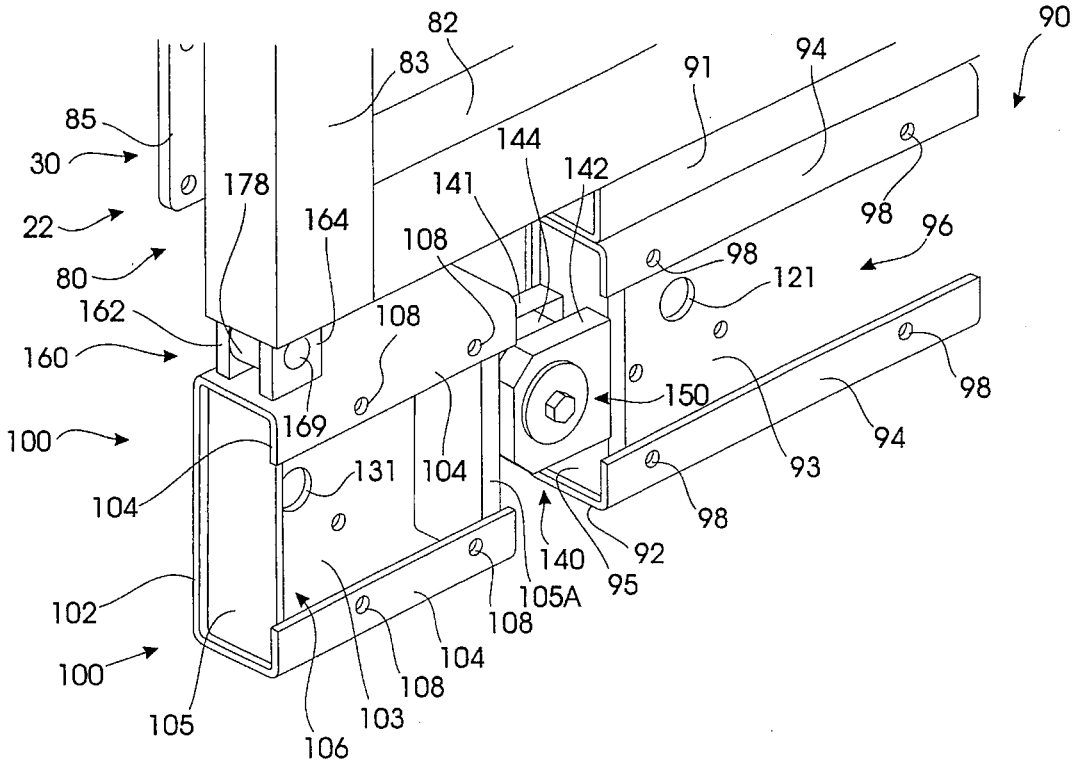
FIG. 7 is a greatly enlarged isometric view similar to FIG. 6, showing a housing on the drive end, with portions omitted and pieces broken away for clarity; and, FIG. 8 is a greatly enlarged, exploded, isometric view similar to FIG. 7, showing an interior axle mounting of a drive roller and the housings of the drive end, with portions omitted and pieces broken away for clarity.
Figure 8:
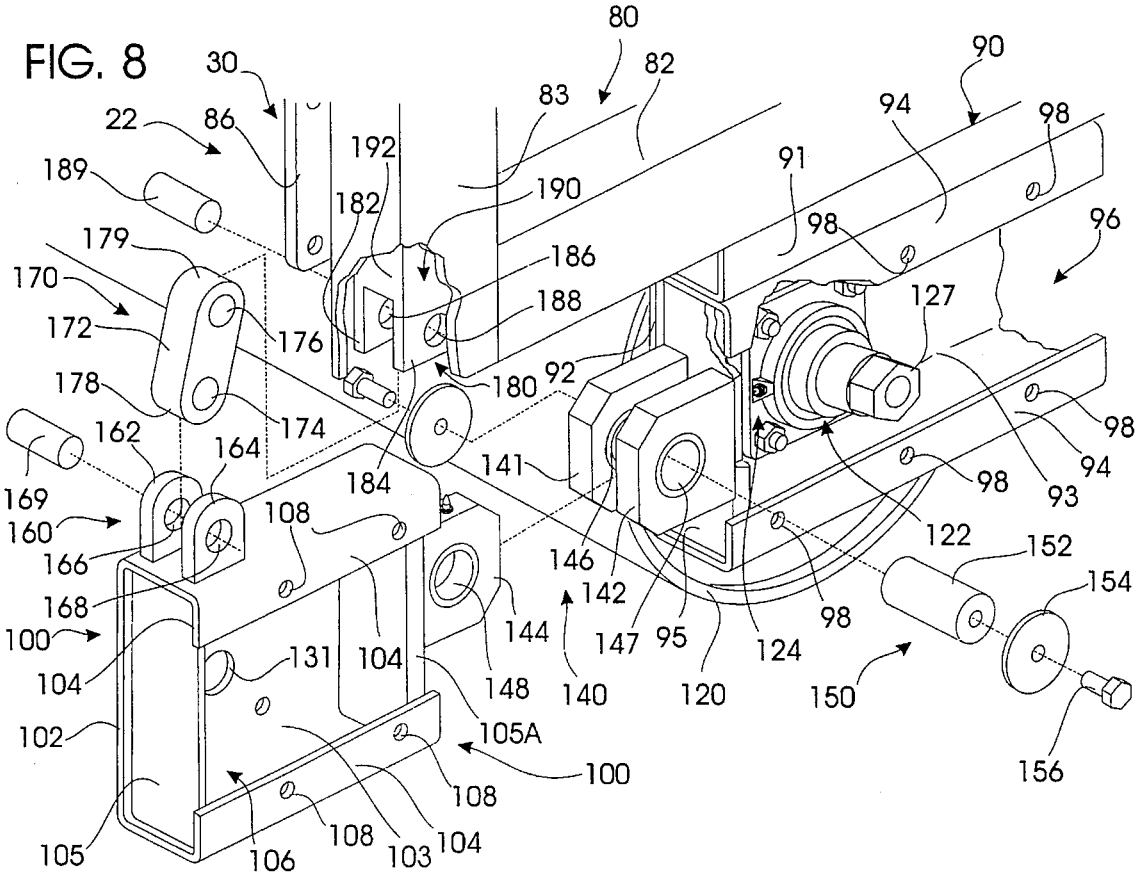

As can be seen in FIGS. 1, 3 and 4, my finishing machine comprises a rigid, box-like frame 22 that rides upon a pair of spaced-apart forms 25 installed upon a surface 27 that is to be paved. Preferably, the frame 22 comprises several tubular, steel members that are assembled into a parallelepiped configuration (FIG. 2). The frame comprises a front end 30 and spaced-apart back end 40 joined by a pair of spaced-apart ends 50, 80. The frame 22 is supported by a plurality of tube rollers 110, 120 and 130.

The frame front end 30 primarily comprises an elongated tubular, sectional member 31 extending between ends 50, 80. While the member 31 may be a solitary component, it may alternatively be comprised of several subcomponents. In a preferred embodiment, member 31 comprises three subcomponent sections 31A, 31B, and 31C that simplify erection and transportation of the apparatus, and enable extension or contraction of the frame width. A pair of tubular supports 32, 33 extends upwardly from each respective end 50, 80 to a juncture 34, 35 with member 31. In one preferred embodiment, the junctures 34, 35 are located about one third of the member's length from the respective ends 50, 80. The location of the junctures is dependent upon the overall length of the frame and the particular specifications the machine is built for.

Each support 32, 33 is bolted to a respective juncture bracket 36, 37 that also bolts to member 31. A pair of bracket handles 38, 39 extends upwardly from member 31 to facilitate lifting of the machine 20. A pair of alternate rings 38A, 39A protrude upwardly from the front member 31 and may also be used to lift the machine 20.

The frame back end 40 comprises essentially the same arrangement as the front end. An elongated, sectional tubular back member 41, which preferably comprises subcomponents identical to member 31, extends between ends 50, 80. A pair of tubular supports 42, 43 extend upwardly from each respective end 50, 80 to a juncture 44, 45 with member 41. The junctures 44, 45 are located about one third of the member's length from the respective ends 50, 80, similarly to the junctures 34, 35. Each support 42, 43 is bolted to a respective juncture bracket 46, 47 that also bolts to member 41. A pair of bracket handles 48, 49 extend upwardly from member 41 to facilitate lifting of the machine 20. A pair of alternate rings 48A, 49A protrude upwardly from the back member 41 and may also be used to lift the machine 20.

The follower end 50 comprises upper and lower cross-members 51, 52 that are vertically connected by front and back vertical members 53, 54 to form a rectangular outline. The front support 32 is anchored to the front vertical member 53 adjacent the lower cross-member 52 by a bracket 55. The front member 31 is anchored to the front vertical member 53 adjacent the upper cross-member 51 by a bracket 56. The back support 42 is anchored to the back vertical member 54 adjacent the lower cross-member 52 by a bracket 57. The back member 41 is anchored to the back vertical member 54 adjacent the upper cross-member 51 by a bracket 58.

A pair of housings extend along the bottom of the lower cross-member 52 to attach the tube rollers 110, 120 and 130 to the frame 22. The first, a fixed housing 60, extends partially along the bottom of lower cross-member 52. The drive rollers 110 and 120 are journalled into housing 60. The second, a pivotal housing 70, is attached immediately below the front vertical member 53. A strike-off roller 130 journals into housing 70.

The drive end 80 is constructed similarly to the follower end 50. Spaced-apart upper and lower cross-members 81, 82 are connected by front and back vertical members 83, 84 to form a rectangular outline. The front support 32 is anchored to the front vertical member 83 adjacent the lower cross-member 82 by a bracket 85. The front member 31 is anchored to the front vertical member 83 adjacent the upper cross-member 81 by a bracket 86. The back support 42 is anchored to the back vertical member 84 adjacent the lower cross-member 82 by a bracket 87. The back member 41 is anchored to the back vertical member 84 adjacent the upper cross-member 81 by a bracket 88.

A pair of housings extend along the bottom of the lower cross-member 82 to attach the tube rollers 110, 120 and 130 to the end of the frame 22. The first, a fixed housing 90, extends partially along the bottom of lower cross-member 82. A tubular intermediate spacer 91 mounts housing 90 to the cross-member 82. The drive rollers 110 and 120 are journalled into the housing 90. The second, a pivotal housing 100, is attached immediately below the front vertical member 83. A strike-off roller 130 is journalled into the housing 100.

The housings and the interior attachment of the rollers to the frame machine are best seen in FIGS. 5–8. The fixed housing 90 comprises a C-shaped beam 92 having a rear wall 93 and a pair of outwardly facing exterior flanges 94. The beam 92 also has an end cap 95 that cooperatively defines an interior compartment 96 where the axle hubs of the drive rollers 110 and 120 are mounted. A removable plate 97 encloses the interior 96 to prevent the entry of contaminants or debris. A series of equidistant orifices 98 permit the mounting of the plate 97.

Essentially all of the roller axles are mounted to the frame similarly, therefore the front drive roller 120 will be used as an example. An orifice 121 penetrates the rear wall 93 to permit the insertion of the axle 122 (FIGS. 7 and 8) into the axle hub 124, thus mounting the roller 120 to the frame 20. A hydraulically driven motor 125 mounts the exterior plate 97 and extends therethrough. The interior portion of the motor 125 couples to a hexheaded shaft 127 to rotate the roller 120. A similar mounting system is employed for hydraulic motors 115 and 135. A similar mounting system is used for both ends of both drive rollers 110, 120.

However, follower end fixed housing 60 encases an auxiliary chain system 115A that maintains the necessary tension in the drive rollers 110, 120 (FIG. 4). The sprocket system comprises a pair of sprockets 116 and 117 connected by a looped chain 118. A tensioner 119 maintains tension in the chain. The axle mountings for the strike-off roller 130 is identical to those of the drive rollers 110, 120 with the exception that the follower end pivotal housing 70 axle mounting spins freely. Since these are the only difference in the axle mountings, the description of the axle mountings will not be unnecessarily duplicated.

The pivotal housing 100 is similar to the above described fixed housing 90. The housing 100 comprises a C-shaped beam 102 having a rear wall 103 and a pair of outwardly facing exterior flanges 104. The beam 102 also has a pair of oppositely disposed end caps 105, 105A that cooperatively define an interior compartment 106 where the axle hubs of the strike-off roller 130 are mounted. A removable plate 107 encloses the interior 106 to prevent the entry of contaminants or debris. A series of equidistant orifices 108 permit the mounting of the plate 107. An orifice 131 penetrates the rear wall 103 to facilitate mounting of the strike-off roller axle. However, unlike the fixed housing 90, the housing 100 is not immobile. Instead, three pivots attach the housing 100 to the frame 20 to allow the housing to pivot, vertically raising and lowering the strike-off roller 130. The vertical movement of the roller 130 varies the distance the axis of rotation 131 is above the forms 25.

The first housing pivot 140 comprises a pair of flanges 141, 142 that receive a tab 144. The flanges 141, 142 protrude from the end cap 95. The tab 144 protrudes from end cap 105A. Each flange 141, 142 is centrally penetrated by an orifice 146, 147. The tab 144 is centrally penetrated by an orifice 148. The tab 144 is aligned between the flanges 141, 142 so that a pin system 150 may be inserted into the aligned orifices 146, 147 and 148 to pivotally attach the housing 100 to the housing 90. The pin system 150 comprises a spacer 152 with a pair of opposing washers 154 and bolts 156.

The second housing pivot 160 is located on top of the housing 100. A pair of upwardly protruding flanges 162, 164 receive a connector 170. Each of the flanges 162, 164 defines a central orifice 166, 168. The connector 170 comprises an elongated body 172 that defines a pair of orifices 174, 176 adjacent its rounded ends. Connector end 178 is aligned between the flanges 162, 164 to permit the insertion of knock-out pin 169 into the orifices 166, 168 and 174.

The third pivot 180 connects an elongated, vertically adjustable shaft 190 to the housing 100. A pair of downwardly protruding flanges 182, 184 are defined in the shaft end 192. The flanges 182, 184 receive the opposite connector end 179. A pair of orifices 186, 188 are defined in flanges 182, 184. A knock-out pin 189 is inserted into the orifices 186, 188 and 176 when they are aligned. Thus, the upper portion of the housing 100 is pivotally attached to the frame via pivots 160 and 180.

A shaft 190 extends interiorly of both front member 53 and 83. The shaft comprises a threaded rod 194 that is sleeved into a hollow tube 196. The rotation of an adjustment nut 198 atop rod 194 moves rod 194 in or out of tube 196. This movement in turn lengthens or shortens the shaft 190 to move the housing 100 upwardly or downwardly. The pivotal movement of housing 100 also vertically moves the strike-off roller 130 relative to the forms 25. In one preferred embodiment, the strike-off roller 130 is capable a vertical displacement of approximately one inch. The vertical displacement of the strike-off roller 130 permits the adjustment of the height of the concrete passing to the drive rollers 110 and 120, as discussed in more detail hereinafter.

The drive end 80 mounts most of the control apparatus, motor and related devices for the machine 20. The follower end 50 mounts a weight box 200 to counterbalance the components at the drive end 80.

A water tank 210 is also located adjacent the follower end 50. The water tank 210 is attached to a sprayer system 215 by a connecting hose 212. The sprayer system 215 comprises a valve 216 that controls the output of water to series of nozzles 218 depending from the front member 31 above the strike-off roller 130. Water contained in tank 210 may be selectively dispensed to clean the strike-off roller 130 or to soften the concrete.

A tool tray 205 is supported near the midpoint and extends between the front member 31 and back member 41. The tool tray 205 may be used for tool storage and functions as a cross-member to structurally augment the stability of the frame 22.

A motor 220 is mounted adjacent the drive end 80 to provide power to the machine. A motor control unit 222 is oppositely mounted on drive end 80. The motor directly powers a hydraulic pump that provides remote power to the drive rollers 110, 120 and 130 via hydraulic motors 115, 125 and 135, as previously discussed. The hydraulic pump is connected to a hydraulic reservoir tank 225. A fill line 227 permits the refilling of the tank 225.

The directional rotation and speed of the rollers 110, 120 and 130 is controlled by a hydraulic valve control system 230. Control valve 232 controls the directional movement as well as the rotational speed of the strike-off roller 130. Control valve 234 controls the directional and rotational speeds of the drive rollers 110, 120. Several stringers 238 support the control system and corresponding shelf 239.

Another control valve 236 controls the deployment of a hydraulically operated displaceable leg 240. Displaceable leg 240 lifts one end of the drive rollers 110, 120 off the form 25 so that the machine 20 may be steered. A contemplated steering assembly could alternatively hydraulically vary the space between the drive rollers.

An operator's platform 250 is suspended from the frame by a pair of chains 252 attached to the platform. An operator may mount the platform and control the operation, speed and direction of the machine via the controls 232, 234, 236 and 222.

OPERATION

Referring more particularly to FIGS. 1, 3 and 4, raw concrete 23 is poured between the forms 27. The self-propelled finishing machine 20 travels along the forms 25 while finishing the concrete 23 therebetween. Typically, the freshly poured concrete is supplied in an excessive amount 305. The excess concrete insures that the resultant product 310 is a uniform, desired depth.

However, this excess, unlevel freshly poured plastic concrete often makes ordinary roller finishers "ride up" on top of the concrete. To prevent "riding up," the finishing machine 20 divides the concrete 23 into three zones 315, 320 and 325. The first zone 315, comprising surplus or excess unlevel, raw concrete 305, is separated from the second or intermediate zone 320 by the action of the strike-off roller 130. The strike-off roller 130 displaces the excess or surplus concrete 305 outwardly and away from the leading edge 30 to form the first or excess zone 315.

The outward movement of the surplus concrete 305 creates a second, intermediate zone 320. The intermediate zone 320 has a predetermined depth 322. The depth 322 may be adjusted by rotating both adjustment nuts 198 to vertically adjust the distance 324 between the strike-off roller 130 and the forms 25. This also varies the distance 324A between the roller's axis of rotation 131 and the forms 25 (FIG. 4).

The drive rollers 110 and 120 contact and compress the concrete 330 in the intermediate zone 320 to form a finished, compacted resultant product 310 in the finished zone 325. The concrete between the rollers 110 and 120 may be subdivided into additional zones depending upon the number of drive rollers used.

As can best be seen in FIGS. 1, 3 and 4, the strike-off roller 130 compacts and compress the concrete 23 as it displaces the surplus concrete 305 outwardly. The drive rollers 110 and 120 compress the concrete 23 while moving over it to produce the finished product 310.

Preferably, when the machine moves forward in the direction indicated by arrow 340, the strike-off roller 130 spins clockwise to displace the surplus concrete 305 outwardly away from the frame leading edge 30. The conventional operational rotational direction of the three roller tubes is represented by arrows 342, 344 and 346 (FIGS. 3–4). The drive rollers 110 and 120 rotate counterclockwise as shown by the arrows 344, 346 to propel the machine 20 forward in the direction of movement 340. However, the drive and strike-off rollers may alternatively be rotated in the opposite direction if so desired. The drive rollers 110, 120 also compress and compact the intermediate zone concrete 330 while moving over it.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A self-propelled, form riding, concrete finishing machine adapted to move over a pair of forms to strike-off, screed and finish concrete contained therebetween, said machine comprising:

a generally parallelepiped frame having a front;

a fixed housing depending downwardly from said frame;

a plurality of rotatable drive tubes rotatably suspended by said fixed housing, said drive tubes moving said frame over said forms while finishing concrete;

a pivot housing beneath said frame coupled to and suspended by said fixed housing;

at least one elongated strike-off tube rotatably suspended by said pivot housing adjacent the front of said frame, said strike-off tube rotating to initially contact concrete;

shaft means associated with said frame and connected to said pivot housing for adjusting the elevation of said strike off tube; and, motor means for rotating said drive tubes and said strike-off tube.

2. The machine as defined in claim 1 wherein said shaft means is pivotally coupled to said pivot housing.

3. The machine as defined in claim 2 further comprising displaceable leg means depending from said frame for steering said machine by selectively raising a selected end of said drive roller means out of contact with said forms.

4. A self-propelled, form riding, tube concrete finishing machine adapted to move over a pair of forms to strike-off, screed and finish concrete contained therebetween, said machine comprising:

a frame having a front;

a fixed housing depending downwardly from said frame;

a pair of rotatable drive rollers rotatably suspended by said fixed housing, said drive rollers moving said frame over said forms while finishing concrete;

a pivot housing beneath said frame adjacent said front coupled to and suspended by said fixed housing;

at least one strike-off roller rotatably suspended by said pivot housing adjacent the front of said frame, said strike-off roller initially contacting concrete;

means associated with said frame and connected to said pivot housing means for adjusting the elevation of said strike off roller;

first motor means for rotating said drive rollers to propel said machine in the desired direction of travel, said first motor means having an associated user operated control means for selectively varying both the rotational speed and direction of travel;

second motor means for rotating said strike-off roller, said second motor means having an associated user operated control means for selectively varying both the rotational speed and direction of rotation of said strike-off roller; and, whereby said strike-off roller is adapted to selectively rotate at a user selected speed, elevation, and rotary direction when said machine moves either forwardly or rearwardly.

5. The machine as defined in claim 4 wherein said means for adjusting the elevation of said strike off roller comprises threaded shaft means pivotally coupled to said pivot housing.

* * * * *